US006237161B1

(12) United States Patent
Lee

(10) Patent No.: US 6,237,161 B1
(45) Date of Patent: May 29, 2001

(54) COMPOUND PROTECTIVE HELMET

(75) Inventor: Te Lung Lee, Tainan Hsien (TW)

(73) Assignee: Lung Huei Safety Helmet Co., Ltd., Tainen Hsien (TW)

( * ) Notice: Subject to any disclaimer, the term of this patent is extended or adjusted under 35 U.S.C. 154(b) by 0 days.

(21) Appl. No.: 09/670,961

(22) Filed: Sep. 26, 2000

(51) Int. Cl.[7] ..... A42B 3/00
(52) U.S. Cl. ..... 2/414; 2/424
(58) Field of Search ..... 2/424, 6.4, 6.5, 2/414

(56) References Cited

U.S. PATENT DOCUMENTS 4,689,836 * 9/1987 Vitaloni ..... 2/424
4,766,615 * 8/1988 Morin et al. ..... 2/421
4,769,857 * 9/1988 Cianfanelli et al. ..... 2/424
5,084,918 * 2/1992 Breining et al. ..... 2/424
5,177,816 * 1/1993 Schmidt et al. ..... 2/424
5,553,329 * 9/1996 Casartelli ..... 2/424
5,687,427 * 11/1997 Lamattina et al. ..... 2/424
5,813,048 * 9/1998 Thom ..... 2/6.5

* cited by examiner

*Primary Examiner*—Rodney Lindsey
(74) *Attorney, Agent, or Firm*—Pro-Techtor International Services

(57) ABSTRACT

A compound protective helmet, allowing firm and stable restriction when a restriction hook provided in the restriction lever is hooked into the restriction trough of the bubble, which is comprised of a bubble, a chin protector, and a visor which is pivoted in the bubble to allow two-stage lift; within, a restriction device is fixed to the chin protector, the restriction device is comprised of a fixing base, a leading block provided in the fixing base, a restriction lever, and positioning pieces fixed inside the chin protector; the fixing base and two slope positioning blocks form an integral part to increase strength and prevent the positioning blocks from breaking; a positioning arc is provided at the outside of the restriction lever, the top and the bottom of the positioning arc is riveted to the positioning base and tightened to the positioning piece respectively, so as to prevent the restriction lever from disengaging from the fixing base and to secure the restriction lever firmly at the inside of the chin protector.

3 Claims, 8 Drawing Sheets

COMPOUND PROTECTIVE HELMET

BACKGROUND OF THE INVENTION

1. Field of the Invention

The present invention relates to a revised structure for a compound protective helmet, and more particularly, to one allows the restriction device to secure firmly to the chin protector without loosening up or falling off, and better hooking and restricting effects of the restriction device than before 2. Description of the Prior Art Whereas, in the prior art of the compound protective helmet, the inadequate structural design leads to poor restriction effects and inconsistent operation. The present inventor thus improves the prior art by tackling the defectives, and publishes the ⌈Compound Protective Helmet⌋, which has been filed for an utility patent, allotted Ser. No. 09/425,137, to the US Patent Office. Said application has been examined with positive outcomes of better and more stable restriction effects than the prior art, and has been awarded a patent. The prevent inventor feels no complacent about the achievement and continues to investigate possible improvement of said case restlessly. Consequently, some of the structural designs that can be further improved have been discovered.

Referring to the original descriptions and drawings of the patent, the original compound protective helmet is essentially comprised of a bubble 1, a visor 2, which can allow two-stage lift, and a chin protector 3 are pivoted to the bubble 1; within, a restriction device 4 is fixed at the inner edge of the chin protector 3 to become a full mask protective helmet. Though the prior art gives consistent visor lift operation and firm restriction of the visor when closed, the following defectives in terms of its structural design and practical use are found:

1. The whole set of restriction device 4 can only be restricted by two limit pieces 461 on the left and right, and the limit pieces also make a restriction lever 44 insert into a guide rail 412 and fix at the inner edge of the chin protector 3. The whole design is not solid enough to ensure a firm connection.
2. The end of the restriction lever 44 is a shape of simple strip; at the state of full mask protective mask, the restriction lever 44 is inserted into the restriction trough 141 at both sides of the bubble 1, without having real restricting and positioning effects. If the chin protector 3 is under externally applied force, the restriction lever 44 retreating from the restriction trough 141 can easily occur.
3. Two slope positioning arcs 45 are protruding inside the chin protector 3; the configuration increases not only the difficulty in making die for the chin protector 3, but also the possibility of striking or breaking of the slope positioning arcs 45.

According to the foregoing, the present inventor tries to improve the chin protector 3 and the restriction device 44. Consequently, numerous trials and modifications lead to the publication of the present invention.

SUMMARY OF THE INVENTION

The primary objective of the present invention is to provide a compound protective helmet that ensures firm fixing and restricting connection of the restriction device.

Figure 1:
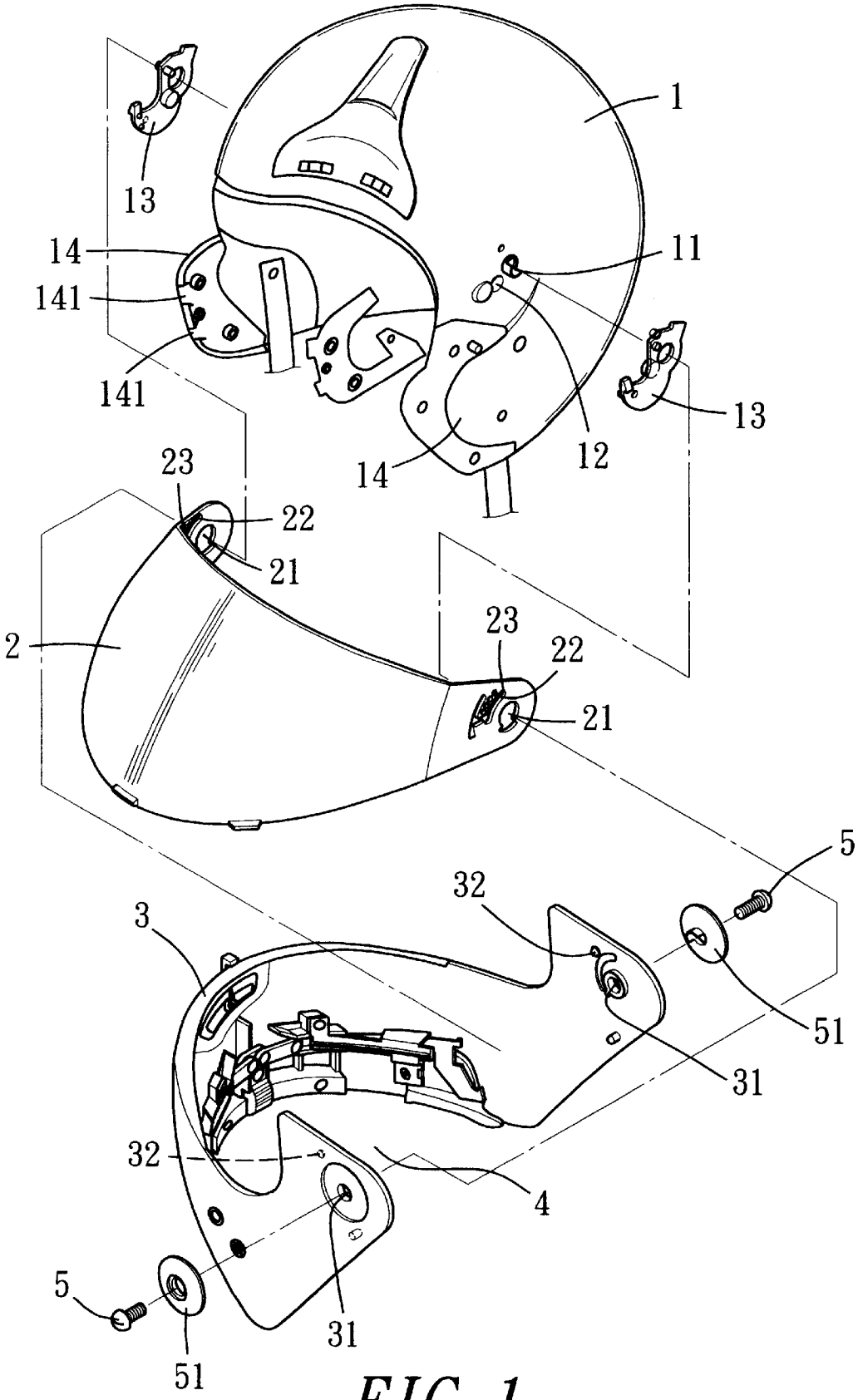
FIG. 1 is a blowout view of the present invention.
Figure 2:
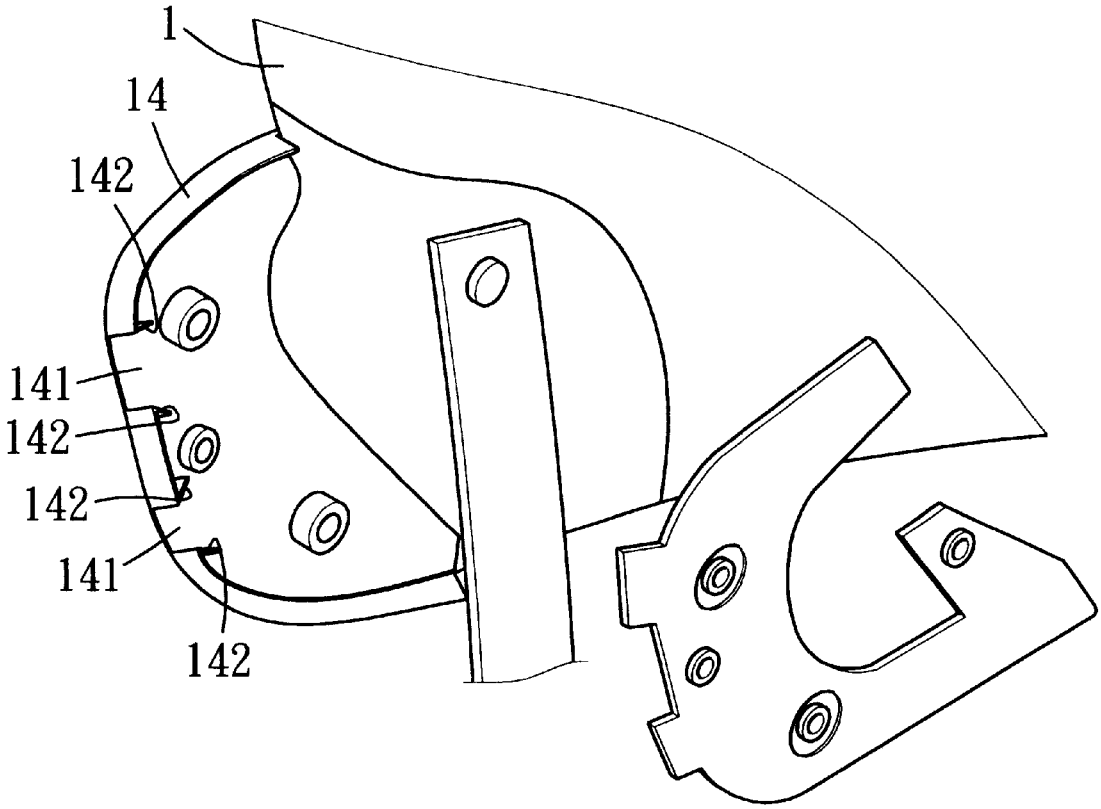
FIG. 2 is a blowout view of local part of the bubble of the present invention.
Figure 3:
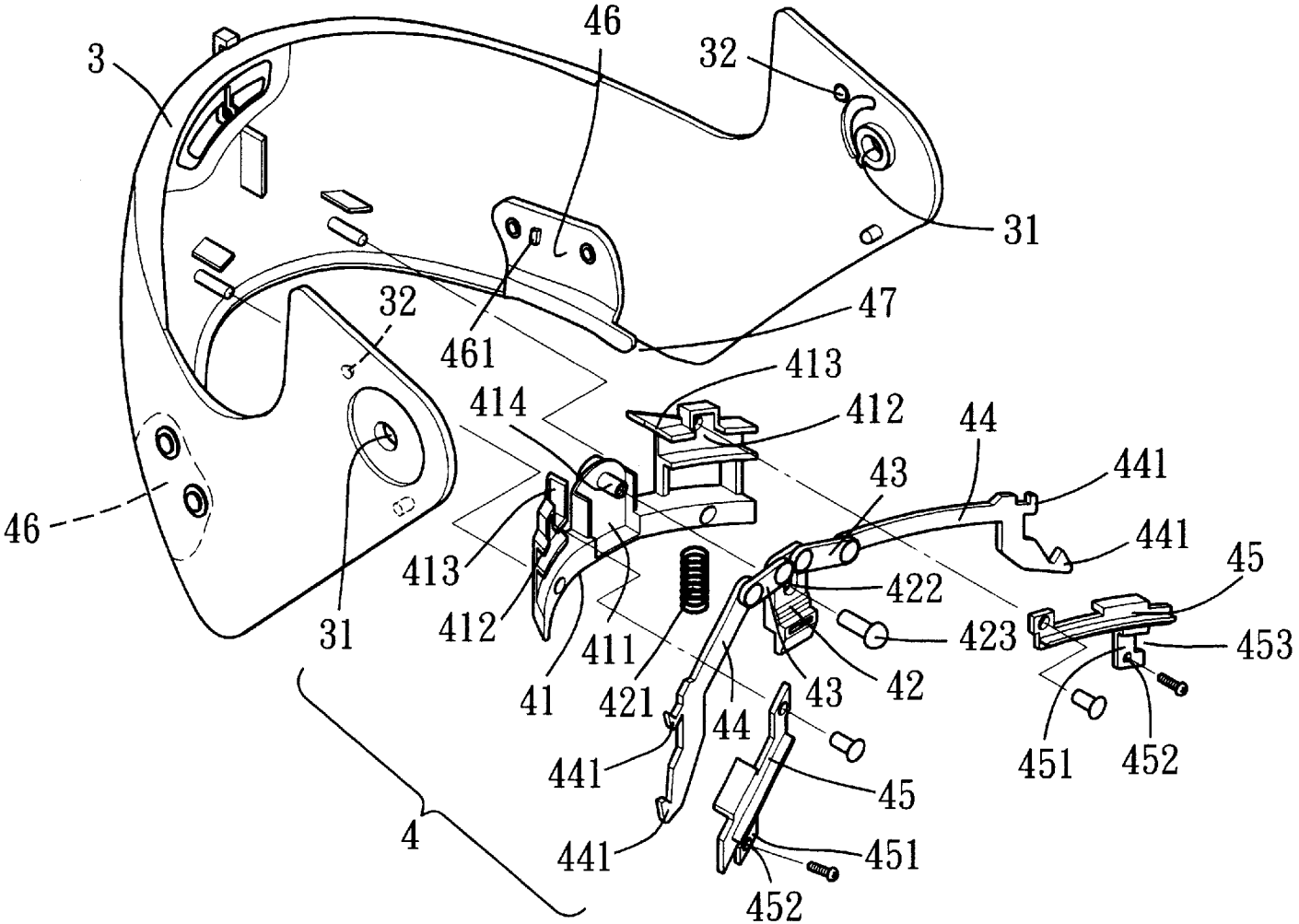
FIG. 3 is a blowout view of a chin protector and a restriction device of the present invention.

DETAILED DESCRIPTION OF TIE INVENTION:

Referring to FIG. 1, the present invention is essentially comprised of a bubble 1, a visor 2 pivoted to the bubble 1 and a chin protector 3. Within, a threaded hole 11 is formed respectively on both sides of the bubble 1, and a concave 12 is provided by the threaded hole 11. A pad 13 in hooked shape is respectively inserted into the concave 12. An ear protector 14 is provided on both sides of the bubble, and two restriction troughs 141 are provided at the front edge of the ear protector 14. A guide piece 142 is provided on the top interior and on the bottom end of the restriction trough 141 respectively, as illustrated in FIG. 2.

On both ends of the visor 2 at where corresponds to the threaded hole 11 on the bubble 1 are respectively provided with a through hole 21, and an arc keyhole 22 is provided at the front end of the through hole 21. Several positioning dents 23 are provided at the arc keyhole 22.

Figure 6:
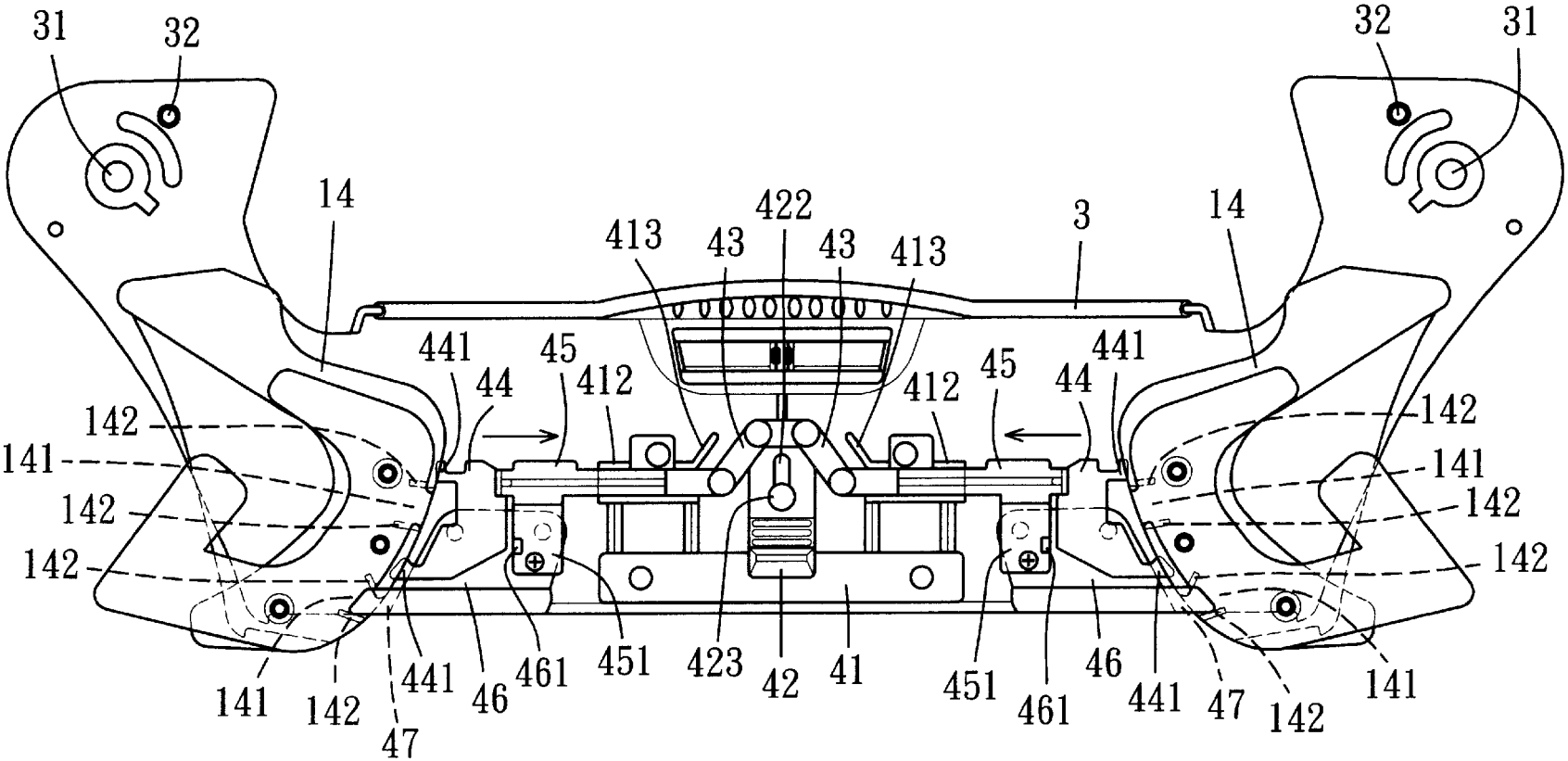
FIG. 6 is a schematic view taken from FIG. 5 with the rear portion extended.
Figure 8:
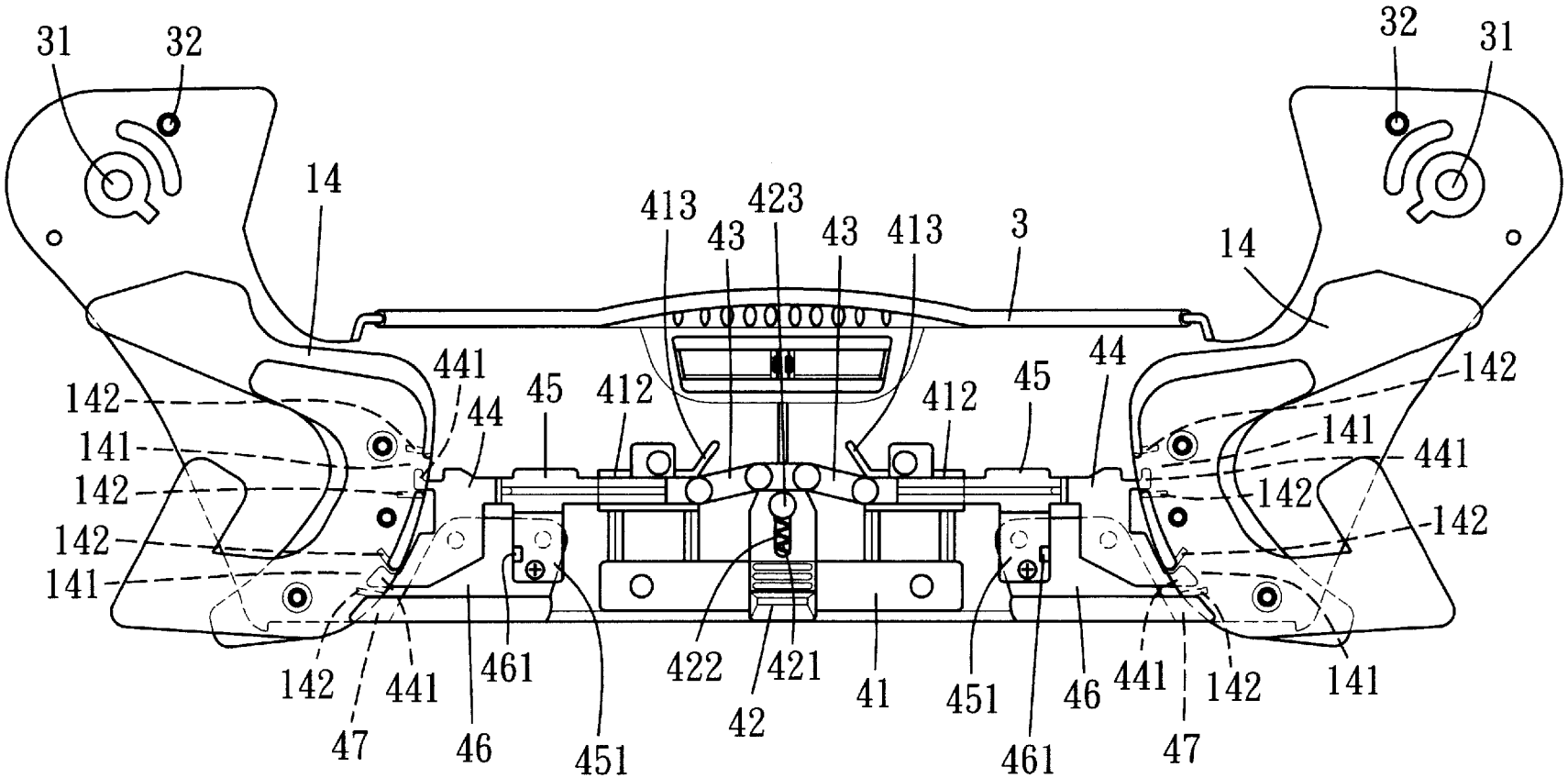
FIG. 8 is a schematic view taken from FIG. 7 with the rear portion extended.

The chin protector 3 is actually an arc-shape frame, with pivoting hole 31 on both ends of the frame. On the interior of the frame at where corresponds to the positioning dents 23 of the visor 2 is provided with a positioning nipple 32. A restriction device 4 is fixed inside the chin protector as illustrated in FIG. 6. Within, the restriction device 4 is comprised of a fixing base 41 with a longitudinally sliding base 411 at its center, a laterally sliding rail 412 is each provided at both sides of said fixing base 41; near the sliding base 411, an integral slope positioning block 413 is each provided on the top of each side of two sliding rails 412; and a leading block 42 inserted with a resilient element 421, a slit 422 is provided on the leading block 42, a bolt 423 penetrates the slit 422 before being received by the threaded hole base 413 so to position the leading block 42 in the sliding base 411, and the resilient element 421 is restricted between the threaded base 413 and the leading block 42 (as illustrated in FIGS. 6 and 8), one end of a linkage 43 is respectively pivoted to both sides at the top of the leading block 42 while the other end of the linkage 43 is connected to a restriction lever 44 inserted into the guide rail 412, and both restriction levers 44 respectively extends backward along the chin protector 3. The front end of the restriction lever 44 is provided with a positioning arc 45 riveted in the sliding rail 412, and the positioning arc 45 extends towards both sides of the chin protector 3; a fixing piece 451 with a through hole 452 is protruded at the lower end of the positioning arc 45, and a notch 453 is provided at the rear of the fixing piece 451; at a bending portion formed at the end of the restriction lever 44 at where corresponds to the restriction groove 141 of the bubble 1 are provided with two protruded restriction hooks 441, the fixing piece 451 at both end of the positioning arc 45 are secured to two positioning pieces 46 so as to enclose the restriction device 44 in the sliding rail 412 of the fixing case 41, two positioning pieces 46 are fixed at both sides of the fixing case 41 situated at the inside of the chin protector 3, two positioning pieces 46 at where corresponding to a notch 453 of the fixing piece 451 is provided with a protruded inserting nipple 461, the inserting nipple 461 is inserted into the notch 453, and a guide trough 47 with its opening facing backward is formed at the bottom edge of both the positioning pieces 46 and the chin protector 3.

Figure 4:
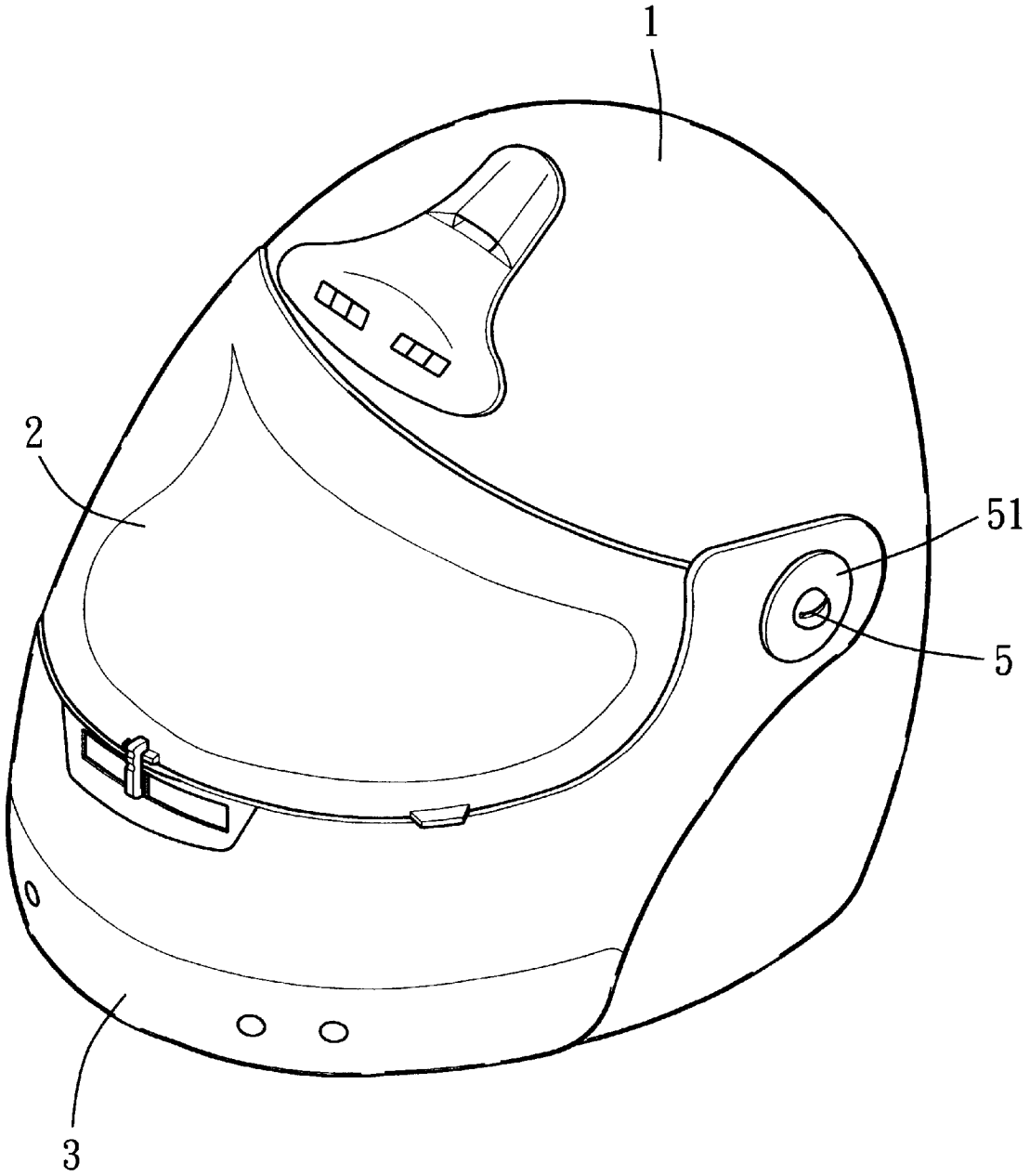
FIG. 4 is a 3D view showing the appearance of the present invention.

FIG. 4 shows the assembly of the present invention, within, two fastening pieces 5 are provided to penetrate in sequence a pad 51, a pivoting hole 31 on the chin protector 3 and a through hole 21 of the visor to fix both of the chin protector 3 and the visor 2 to the bubble 1. For the present additional invention, the positioning of visor 2 during lifting and closing is achieved by matching the positioning dent 23 of the visor 2 and the positioning nipple 32 of the chin protector 3. The lifting and positioning operations are identical with the original invention, and not discussed further here because they are not central to the present invention.

Figure 5:
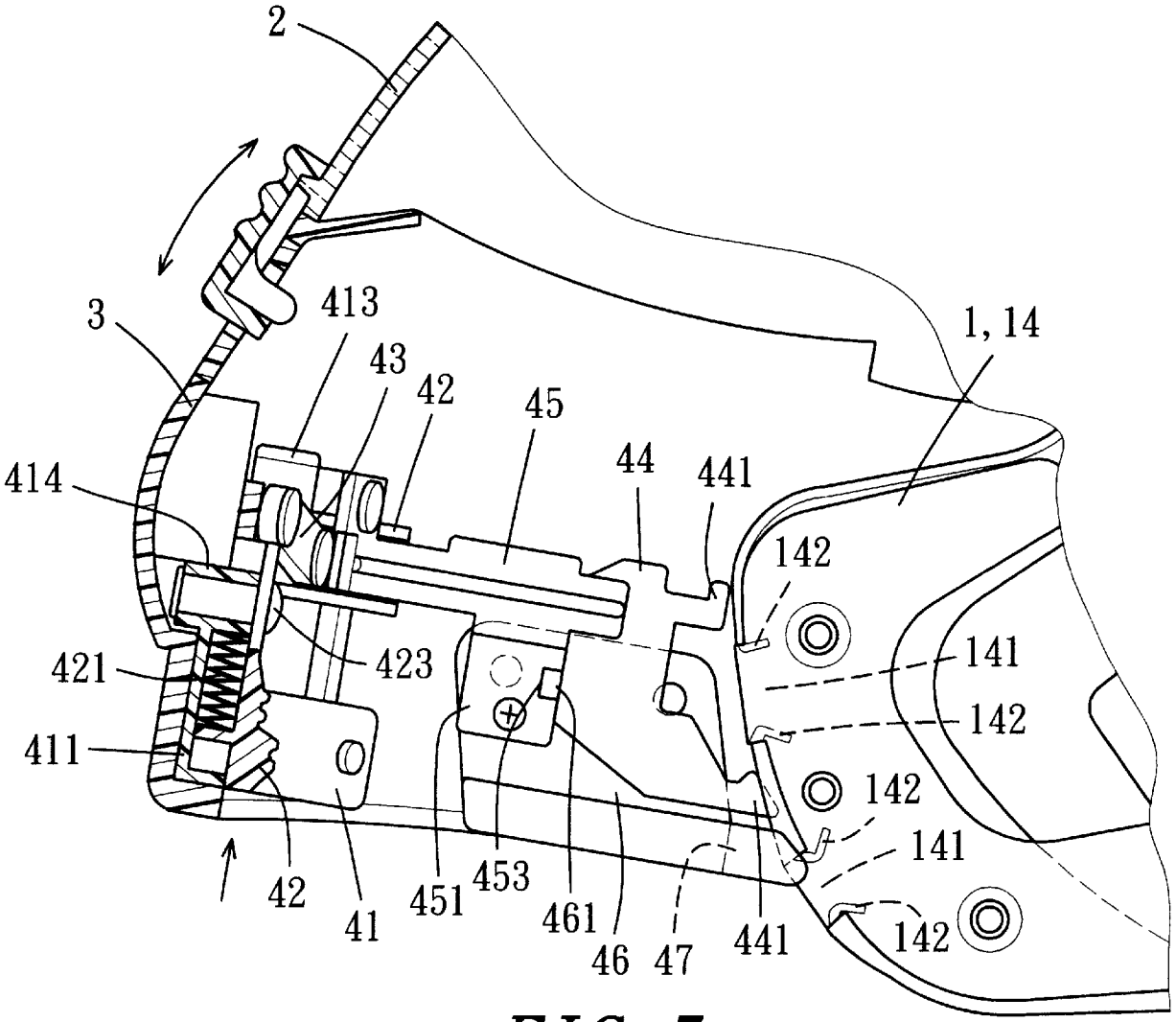
FIG. 5 is a view showing the operation to lift and close the chin protector of the present invention.
Figure 7:
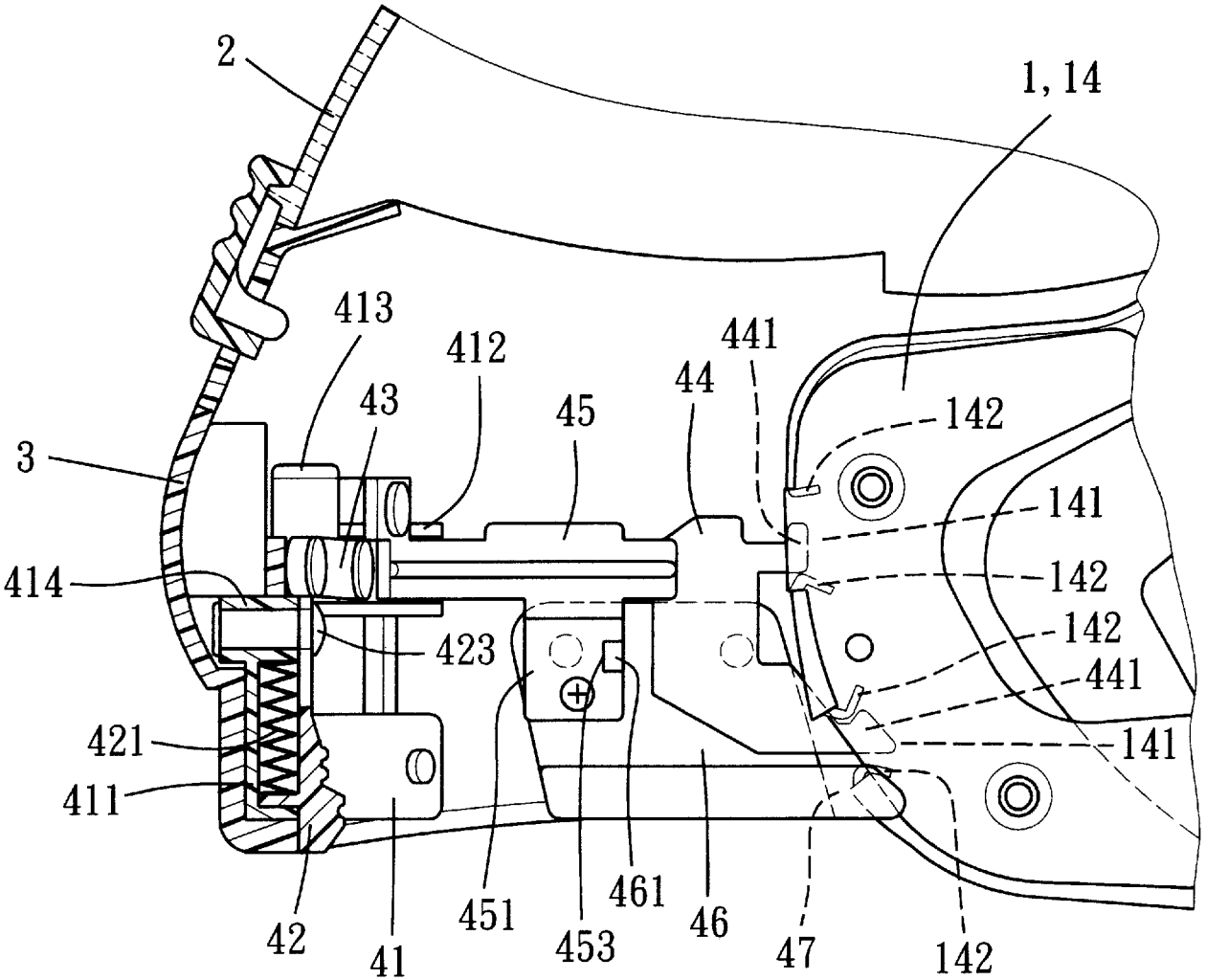
FIG. 7 is a sectional view of the present invention with its chin protector restricted by the bubble.

The operations of the chin protector 3 and the restriction device 4 are illustrated in FIGS. 5 to 8. Referring to FIGS. 5 and 6, to lift up the chin protector, just push up the leading block 42 to compress the resilient element 421 inside the leading block 42 while both linkages 43 are moved upward inclining to protrude and arrive at both slop positioning blocks 413; the other ends of the linkages 43 pull both restriction levers 44 to move towards the fixing base 41 through the sliding rail 412, and subsequently to make the restriction hooks 441 on the lower end of the restriction lever 44 retreat from two restriction troughs 141 at the ear protector 14 of the bubble 1, so that the chin protector 3 is lifted up until it is restricted by the position nipples 32 and the pad 13 and the chin protector 3 can be positioned outside of the bubble 1 to secure in the position of halfway open status. This part of design is identical with the original invention, and not discussed further here because they are not central to the present invention. To restore to the full mask status, just pull down the chin protector 3 so that the ends of both restriction levers 44 slid along the ear protector 14 of the bubble 1; as illustrated in FIGS. 5 and 6, the ear protector 14 also is guided into the restriction trough 141 along the guide trough 47 formed by the chin protector 3 and the positioning piece 46, the resilient element 421 in the leading block 42 is restored and both restriction hooks 441 at the ends of two restriction levers 44 are inserted into and restricted by the restriction trough 141 for positioning as illustrated in FIGS. 7 and 8, that is, returned to the fully-lifted status as shown in FIG. 4.

Apart from the advantages of the original invention, i.e., two-stage-lifting, and smooth and consistent operation, the present invention allows the additional advantages:

1. The leading block 42 of the restriction device 4 is riveted directly to the sliding base 41; whereas, after being inserted in the sliding rail 412, the restriction device 4 is fixed its front end on a positioning arc 45 with covering effect, so as to achieve an integral restriction device 4, providing a solid and loosening-free restriction 3.
2. The slope positioning block 413 made in a single piece is secured in the fixing block 41, so the chin protector 3 does not need additional slope positioning block. This design not only simplify the manufacturing and fabricating processes of the chin protector 3, but also reduce the risk of breaking or falling of slope positioning blocks from the chin protector.
3. After being placed inside the chin protector 3, the restriction device 4 is tightened to the chin protector 3 by the fixing piece 451 of the positioning arc 45. This tightening effect is much more solid than the limit piece adopted in the original invention; also, by matching the riveting point on the upper part of the positioning arc 45, the restriction lever 44 is firmly inserted into the sliding rail 412, without the risk of coming off.
4. Two restriction hooks 441 are protruded at a bending portion formed at the end of the restriction lever 44 to have the hooking effects by hooking the restriction lever 44 to the restriction trough 141 at the ear protector 14 of the bubble 1. This design can prevent the situation of the restriction lever coming off the trough in the original invention in which only an inserting mechanism is facilitated.

What is claimed is:

1. A compound protective helmet comprising:

a shell with a mounting pad affixed to each of two opposing sides of said shell, said opposing sides of said shell each comprise an ear protector with a restriction trough at a front side thereof;

a visor pivotally attached to said shell, said visor includes an arced keyhole slot in each of two opposing sides of said visor, said visor further includes a plurality of positioning dents positioned along said arced keyhole slot;

a chin protector pivotally attached to said shell, said chin protector includes a positioning nipple protruding from each of two sides of said chin protector at positions such that said positioning nipples are received in one of said positioning dents in said visor; and a restriction device affixed to an interior of said chin protector, said restriction device comprises a fixing base, a sliding base is positioned at a central portion of said fixing base, a lateral sliding slot is positioned at each of two sides of said fixing base, a leading block is slidably mounted in said sliding base such that said leading block can be moved up and down in said sliding base, a spring urges said leading block toward a lowered position in said sliding base, a first end of each of two linkage bars is pivotally attached to said leading block, while a second end of each of said two linkage bars is pivotally attached to one of a pair of restriction levers, said restriction levers are received in said sliding slot of said sliding base, a positioning piece is fixed on each of two opposing sides of said interior of said chin protector, a guide trough is formed at a bottom edge of both of said positioning pieces and said chin protector; such that when said chin protector is in a secured position, a restriction hook protruding from each of said restriction levers are received in said restriction troughs of said ear protectors on said shell, and when a user moves said leading block up in said sliding base, said restriction hooks are released from said restriction troughs, thereby allowing the user to pivot said chin protector.

2. A compound protective helmet as claimed in claim 1 wherein:

an arced positioning element is attached to each of two opposing sides of said fixing base to secure said restriction levers in said sliding slots, a fixing piece at an end of each said arced positioning element meshes with a protrusion on each of a corresponding one of said positioning pieces of said chin protector to secure said arced positioning elements in place.

3. A compound protective helmet as claimed in claim 1 wherein:

said ear protectors of said shell are each provided with guide pieces at both top and bottom ends of said restriction troughs to guide said restriction levers of said restriction device.

* * * * *